US009330519B2

(12) United States Patent
Busto

(10) Patent No.: US 9,330,519 B2
(45) Date of Patent: May 3, 2016

(54) AUTOMATIC DISPENSING MACHINE

(75) Inventor: Felix Guindulain Busto, Peralta (ES)

(73) Assignee: JOFEMAR, S.A., Peralta (ES)

( * ) Notice: Subject to any disclaimer, the term of this patent is extended or adjusted under 35 U.S.C. 154(b) by 130 days.

(21) Appl. No.: 13/442,341

(22) Filed: Apr. 9, 2012

(65) Prior Publication Data

US 2012/0285980 A1 Nov. 15, 2012

Related U.S. Application Data

(60) Provisional application No. 61/479,346, filed on Apr. 26, 2011.

(51) Int. Cl.

| | |
|---|---|
| ***G07F 11/00*** | (2006.01) |
| ***G07F 11/16*** | (2006.01) |
| ***G07F 11/24*** | (2006.01) |
| ***G07F 11/42*** | (2006.01) |

(52) U.S. Cl.

CPC ..... *G07F 11/165* (2013.01); *G07F 11/24* (2013.01); *G07F 11/42* (2013.01)

(58) Field of Classification Search

CPC ..... G07F 11/165; G07F 11/20; G07F 11/22
USPC ..... 221/151–154, 248–249, 13
See application file for complete search history.

(56) References Cited

U.S. PATENT DOCUMENTS

| | | | | |
|---|---|---|---|---|
| 3,344,953 | A * | 10/1967 | Merrill Krakauer et al. | 221/75 |
| 4,094,440 | A * | 6/1978 | Lotspeich | 221/12 |
| 4,108,333 | A * | 8/1978 | Falk et al. | 221/13 |
| 4,823,984 | A * | 4/1989 | Ficken | 221/96 |
| 5,236,103 | A * | 8/1993 | Ficken et al. | 221/124 |
| 5,909,823 | A * | 6/1999 | Ranft et al. | 221/129 |
| 6,494,342 | B1 * | 12/2002 | Wittern et al. | 221/192 |
| 6,571,988 | B2 * | 6/2003 | Bowen | 221/274 |
| 6,719,168 | B2 * | 4/2004 | Nicolini | 221/85 |
| 7,264,138 | B2 * | 9/2007 | Collins et al. | 221/191 |
| 7,712,628 | B2 * | 5/2010 | Guindulain Vidondo | 221/155 |
| 8,061,555 | B2 * | 11/2011 | Guglielmi et al. | 221/13 |
| 8,109,410 | B2 * | 2/2012 | Collins et al. | 221/191 |
| 2005/0023286 | A1 * | 2/2005 | Pinney | G06F 19/3462 221/123 |
| 2007/0089339 | A1 * | 4/2007 | Vidondo | 40/606.04 |
| 2009/0076650 | A1 * | 3/2009 | Faes | G07F 11/165 700/232 |
| 2011/0017761 | A1 * | 1/2011 | Roncari | G07F 11/42 221/1 |
| 2011/0226795 | A1 * | 9/2011 | Sichich | 221/1 |
| 2012/0277904 | A1 * | 11/2012 | Pritchard et al. | 700/232 |

FOREIGN PATENT DOCUMENTS

| | | |
|---|---|---|
| ES | 2277532 B2 | 7/2007 |

* cited by examiner

*Primary Examiner* — Michael K Collins
(74) *Attorney, Agent, or Firm* — Blank Rome LLP

(57) ABSTRACT

The present invention relates to an automatic dispensing machine having an elevator for transporting the products from the tray area to the collection box, which increases the capacity of the products that can be dispensed, in addition to increasing the machine's capacity due to the fact that it can store a larger number of products for being subsequently dispensed, due to the fact that the elevator comprises a rotatable upper lid which allows the rotating shaft of the product collection door to be disposed at a greater height than the upper lid of the elevator, thereby increasing the capacity of the elevator and that of the products that can be dispensed, as well as the number of tray rows.

20 Claims, 7 Drawing Sheets

AUTOMATIC DISPENSING MACHINE

This application claims the benefit of U.S. Provisional Application Ser. No. 61/479,346, filed Apr. 26, 2011, which is hereby incorporated by reference.

OBJECT OF THE INVENTION

The present invention relates to an automatic dispensing machine having an elevator for transporting the products from the tray area to the collection box which, due to its special configuration, increases the capacity of the products that can be dispensed, as well as increasing the machine's capacity on being able to store a larger number of products for subsequent dispensing thereof.

The object of the invention consists of a dispensing machine having a system for blocking the elevator thereof, eliminating the possibility of accessing the tray area by moving the elevator vertically, which prevents stealing the products disposed on the trays through the dispensed product collection door.

Due to its special configuration, the elevator comprises the collection box wherefrom the user collects the products, which avoids the need of including additional elements for transporting the products from the elevator to the collection box, thereby increasing the useful space of the machine available for storing products.

BACKGROUND OF THE INVENTION

A wide range of coin-, banknote- or card-operated automatic dispensing machines are known to exist in the state of the art.

Said machines have a glazed front part displaying the different products, generally food products, which are disposed in several compartments of a plurality of storage trays, said product storage compartments being oriented towards the front of the machine so as to allow the user to see the variety of products to be dispensed by selecting the desired product from among these.

There are dispensing machines of this type where the selected product falls by gravity from the corresponding storage compartment towards a collection tray located on the lower part of the machine.

There are other dispensing machines, such as that described in Spanish patent ES2277532 B2 relating to an "advertising device for dispensing machines" from the same applicant as the present patent application, which is based on a dispensing machine having a glazed front part and a plurality of trays wherein the products are stored in a series of compartments and a tray for receiving the dispensed product formed by an ascending/descending body by way of an elevator, with regard to the inner side of the glazed front part.

Therefore, when the user selects a product, the ascending/descending body is firstly positioned with regard to the corresponding tray in order to receive the respective product and be directed towards the collection box.

In the earlier machine, additional elements for transporting the products from the elevator to the collection box must be included, thereby reducing the useful space of the machine available for storing products.

In earlier machines, even in the event that the product collection box were disposed inside the elevator, the product collection door would be disposed at the same height as said box or front space in the front part of the elevator for extracting the products, due to which the height of the products to be extracted would be proportional to the height of the product collection door.

In order to dispense products of greater height, the dimensions of both the collection door and the front space disposed in the front of the elevator to extract the products and, therefore, that of the elevator itself must be increased, thereby reducing the height of the machine that would be destined for housing trays containing products, decreasing the capacity thereof.

The dispensing machine of the present invention resolves all the aforementioned drawbacks, as it has a configuration wherein an increase in the height of the products to be dispensed does not represent a decrease in the height of the machine destined for housing trays containing products.

DESCRIPTION OF THE INVENTION

The present invention relates to an automatic dispensing machine, of the type that may or may not be cooled, which can include payment means or be controlled by another machine and which comprises an elevator which due to its special configuration increases the capacity of the products that can be dispensed, in addition to the fact that the capacity between tray rows increases.

The front part of the machine comprises a window wherethrough the products to be selected by the user can be observed, as well as a rotatable product collection door.

The elevator comprises operation means which allow the machine to move in a vertical direction, both upwards to collect a certain product disposed in a certain tray of the machine and downwards to transport the product to a collection box where the user can extract it from the machine.

The machine comprises one or several extractors associated with operation means that drag the product from a channel of a certain product from among those disposed in each tray towards the elevator, which has previously positioned itself in front of the tray that includes the channel wherefrom the product will be extracted.

The dispensing machine comprises a first device for positioning the elevator with regard to the machine frame, which determines the height of the elevator with regard to the frame at all times, and a second elevator positioning device, in this case with regard to the trays, which determines the relative position between the elevator and the trays at all times.

Additionally, the elevator comprises a product collection box by a user, having a detection device that determines whether a product has fallen inside the collection box. When the detection device determines that a product has fallen inside the collection box, the operation means associated with the extractor stop the movement thereof, moving the elevator towards a first position described hereunder.

The elevator positioning device establishes two positions with respect to the machine frame: a first position wherein the elevator collection box is positioned opposite the product collection door and the product collection door can be opened from the exterior of the machine by a user; and a second position wherein the product collection door cannot be opened due to the presence of opening blocking means of said door, in such a way that it is not possible to gain access to the elevator from the exterior of the machine.

Passage to this second position is carried out when the detection device detects that the user has introduced his/her hand to collect the product. In said second position the machine activates a scanning device to determine the existence of any obstacle which has been introduced from the exterior that will prevent the normal operation of the elevator as it moves towards the product trays, whereupon it is ready to perform a new extraction.

The machine has elevator blocking means that prevent the vertical movement of the elevator through the collection door when said elevator is in the first position or product collection position, in such a way that it is not possible to manually move the elevator through the collection door to gain access to the products disposed on the trays.

The front part of the machine has a micro-controller that determines if said front part is in a use position or is positioned away from the machine in situations such as the maintenance or replenishment of the products disposed on the trays.

The elevator comprises an upper lid that prevents to gain access to the tray area from the product collection door in the first or collection position. Said upper lid is rotatable, which allows the rotation shaft of the product collection door to be disposed in a greater height than the upper lid, in such a way that the product collection box included in the elevator may house products of greater height, on increasing the height of said box by rotating the upper lid of the elevator.

The rotatable upper lid and, therefore, the increased height of the product collection box allows the configuration of a dispensing machine wherein the distance between the highest and the lowest tray is greater than if the lid were fixed, without varying the height of the machine or the height thereof destined to the trays, enabling the inclusion of a larger number of trays in the machine and, therefore, greater product dispensing capacity.

DESCRIPTION OF THE DRAWINGS

In order to complement the description being made and with the object of helping to better understand the characteristics of the invention, according to a preferred embodiment thereof, a set of drawings has been included as an integral part of said description, wherein the following has been represented in an illustrative and non-limiting manner.

PREFERRED EMBODIMENT OF THE INVENTION

Figure 1:
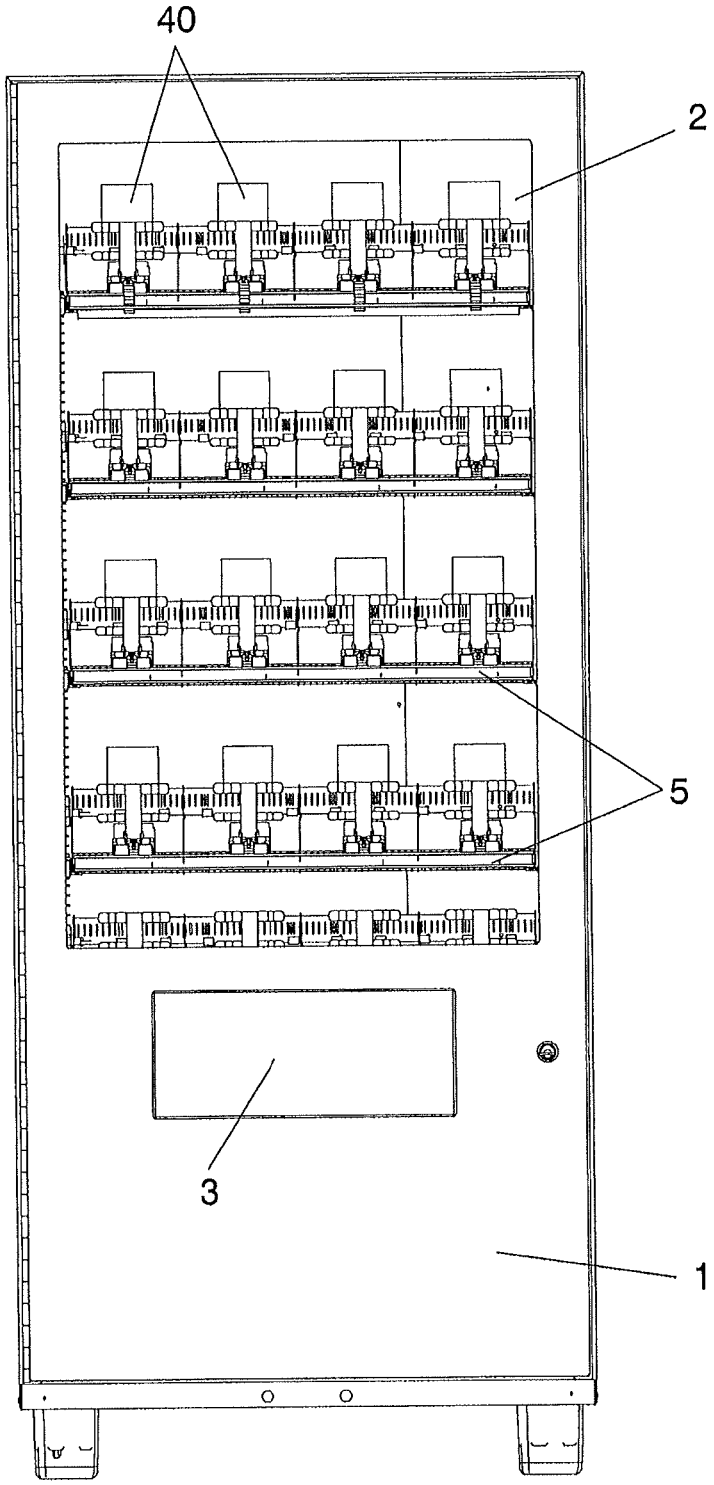
FIG. 1 shows a perspective view of the dispensing machine of the present invention.
Figure 2:
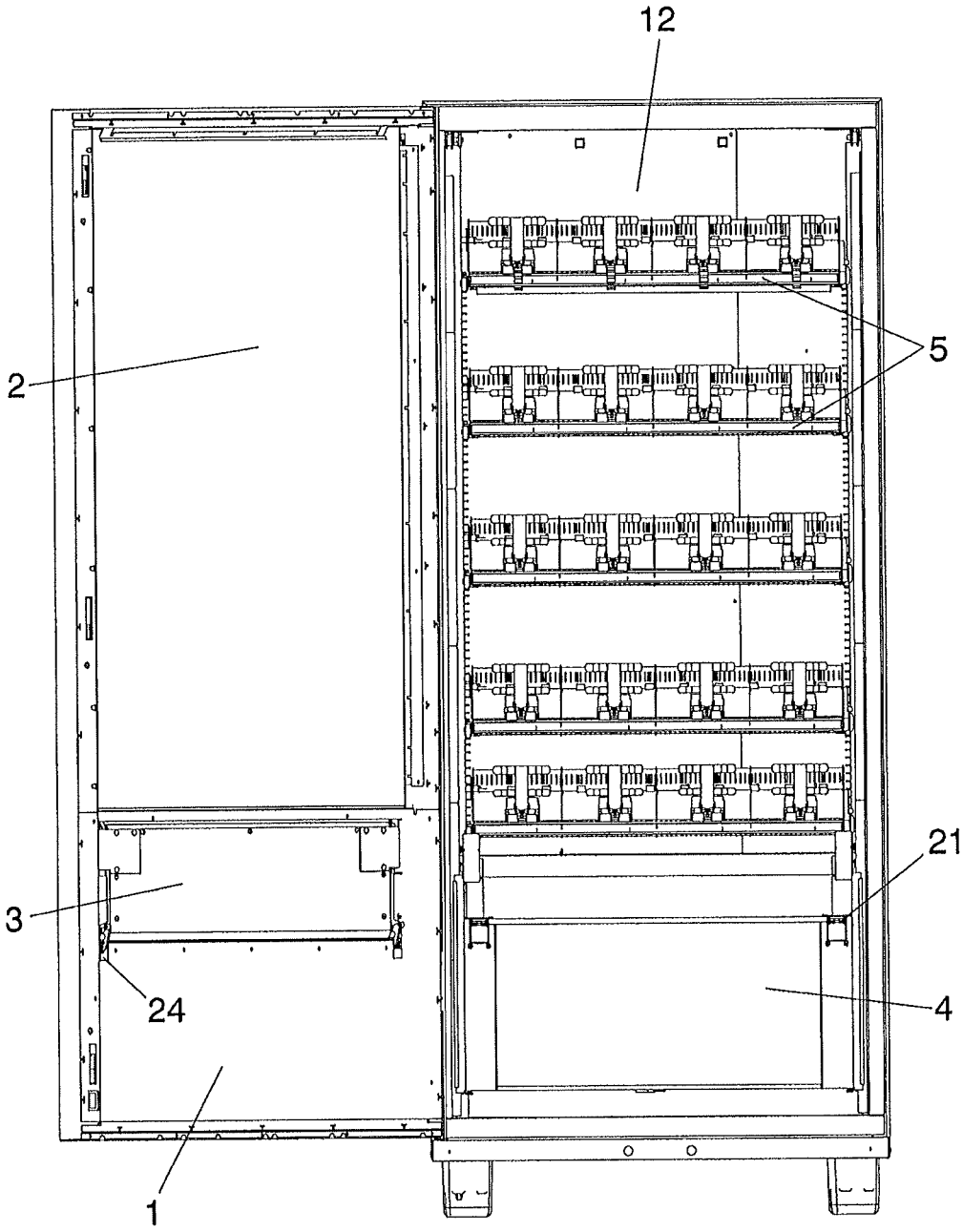
FIG. 2 shows a perspective view of the dispensing machine of FIG. 1 when the front part thereof is open.

In light of the figures, a preferred embodiment of the automatic dispensing machine is described below having a front part (1) comprising a glazed window (2) wherethrough the user observes the products (40) to be selected, in addition to a product collection door (3).

The machine comprises an elevator (4) that moves along the vertical direction of the machine, in an upward direction to collect a certain product (40) disposed in a certain tray (5) of the machine and in a downward direction to move the product (40) disposed in a collection box (6) present in the elevator (4) to a position opposite to the product collection door (3) disposed in the front part of the machine (1).

The vertical movement of the elevator (4) is carried out using operation means that in this preferred embodiment comprise a motor (7) which, by means of a shaft (8), transmits the rotation to two toothed pinions (9) disposed on either lateral sides of the elevator (4), said toothed pinions (9) engaging with teeth (10) present in both racks (11) disposed one on either side of the machine frame (12).

The racks have a sliding surface (13) opposite the teeth (10), in such a way that at the same time that the toothed pinions (9) engage with said teeth (10), a slipper (14) disposed on the lateral sides of the elevator that slides along the sliding surface (13).

The rotation of the motor (7) in a first direction results in the upward movement of the elevator (4), while the rotation of the motor (7) in a second direction opposite the first results in the downward movement of the elevator (4).

The elevator (4) also comprises two counterweights (not shown) joined thereto by joining means that slide along pulleys, in such a way that the elevator is disposed on one side of the pulleys and the counterweights are disposed on the other side of the pulleys, whereupon the elevator (4) is balanced at all times, said counterweights being guided by guides that facilitate movement thereof.

The dispensing machine comprises a first device for positioning the elevator (4) with regard to the frame (12) of the machine, which in this preferred embodiment comprises an emitter photocell (15) disposed in the elevator and oriented toward the machine frame (12) where two receiver photocells (16) and a second elevator (4) positioning device with regard to the trays are disposed in this case, comprising an emitter photocell (15) disposed in the elevator (4) and oriented toward the product (40) trays (5), each of which (5) has a receiver photocell (16).

The machine has one or several extractors (not shown) between the trays (5) and the elevator (4) which drag the product (40) from a channel of a certain product (40) from among those disposed on each tray (5) wherefrom the product will be extracted (40).

The product collection box (6) comprises a detection device to determine whether any product (40) has fallen inside the collection box (6) or not, which in this preferred embodiment is a photocell band (35) disposed on one of the lateral sides of the collection box (6) which is disposed opposite to another photocell band (35) disposed on the other lateral side of the box (6) which detect when a product (40) falls inside the collection box (6), moment in which the extractor is stopped.

The elevator (4) positioning device establishes two positions with regard to the machine frame (12), i.e. the emitter photocell (15) disposed in the elevator and oriented towards the two receiver photocells (16) of the machine frame (12).

Figure 3:
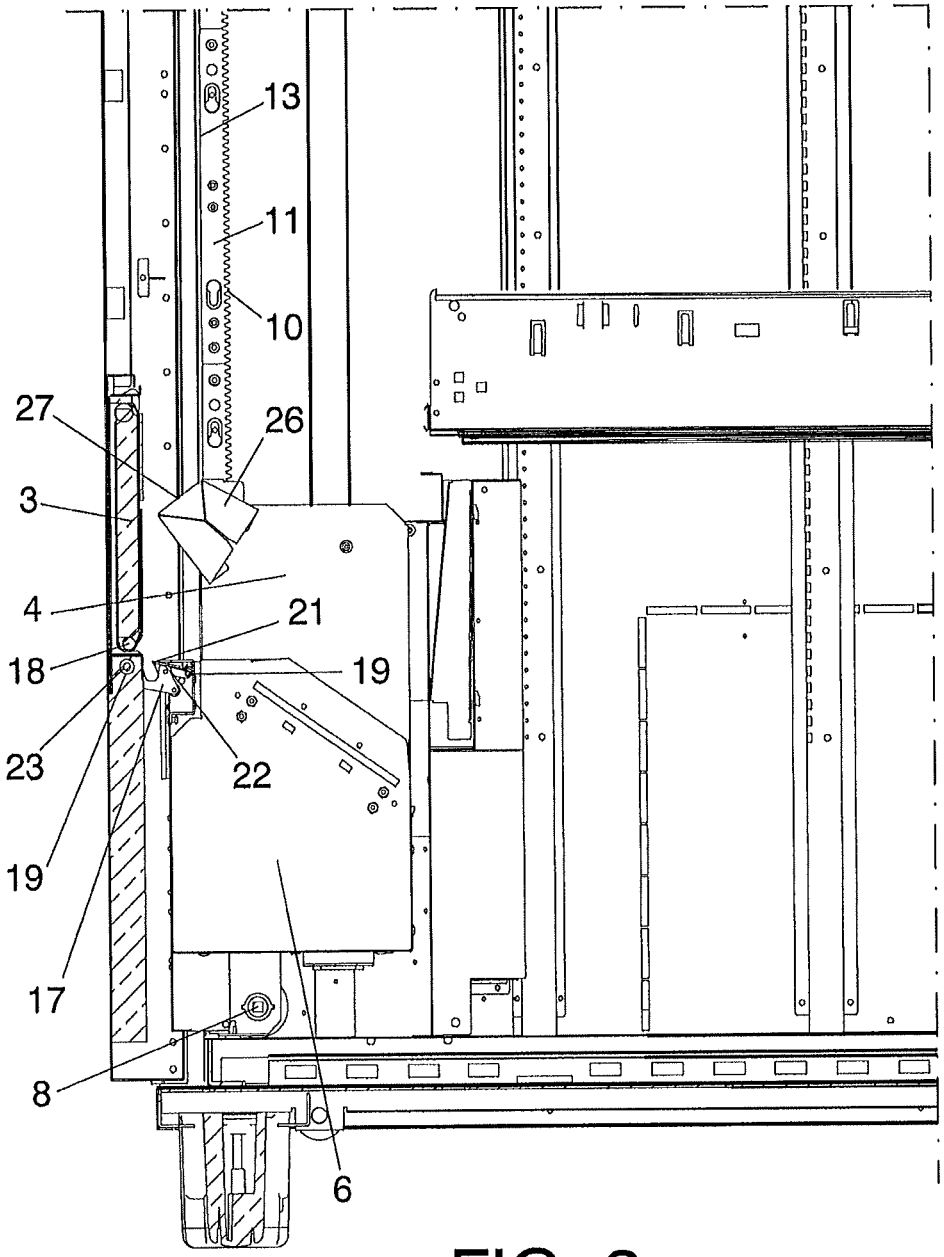
FIG. 3 shows a cross-sectional view of the dispensing machine of FIG. 1 in the first position, wherein the elevator collection box is disposed opposite the product collection door and said product collection door can be opened from the exterior of the machine by a user, with said door closed. The upper lid of the elevator has not been shown for greater clarity.
Figure 4:
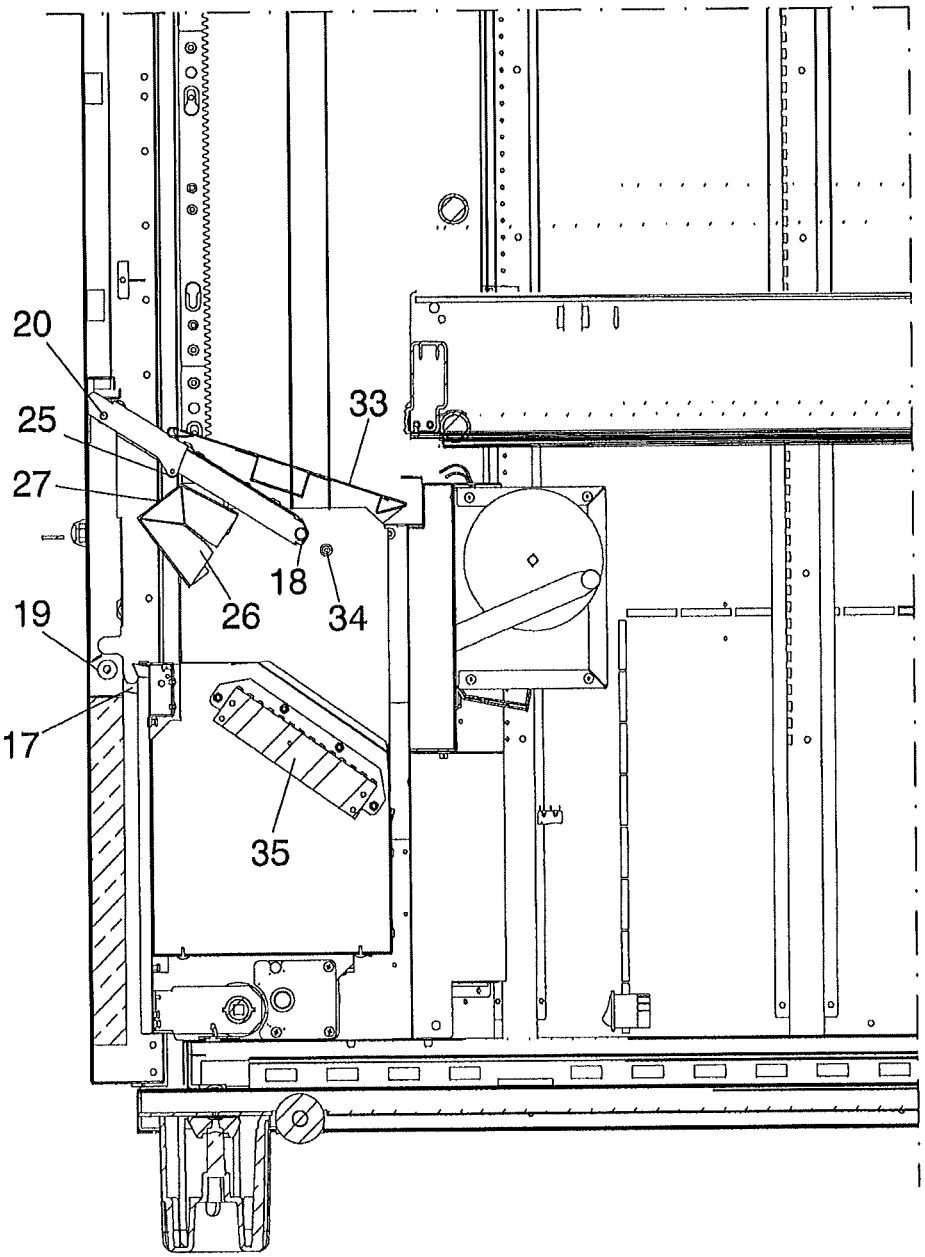
FIG. 4 shows a cross-sectional view of the dispensing machine of FIG. 1 in the first position shown in FIG. 3, with the product collection door closed.

In a first position wherein the elevator (4) collection box (6) is disposed opposite to the product collection door (3), said product collection door (3) can be opened from the exterior of the machine by a user but the elevator cannot be moved vertically along the collection door (3) to access the products (40) disposed on the trays (5) due to elevator blocking means which will be described in detail later. This first position of the elevator (4) with regard to the machine frame (12) is shown in FIGS. 3 and 4.

Figure 5:
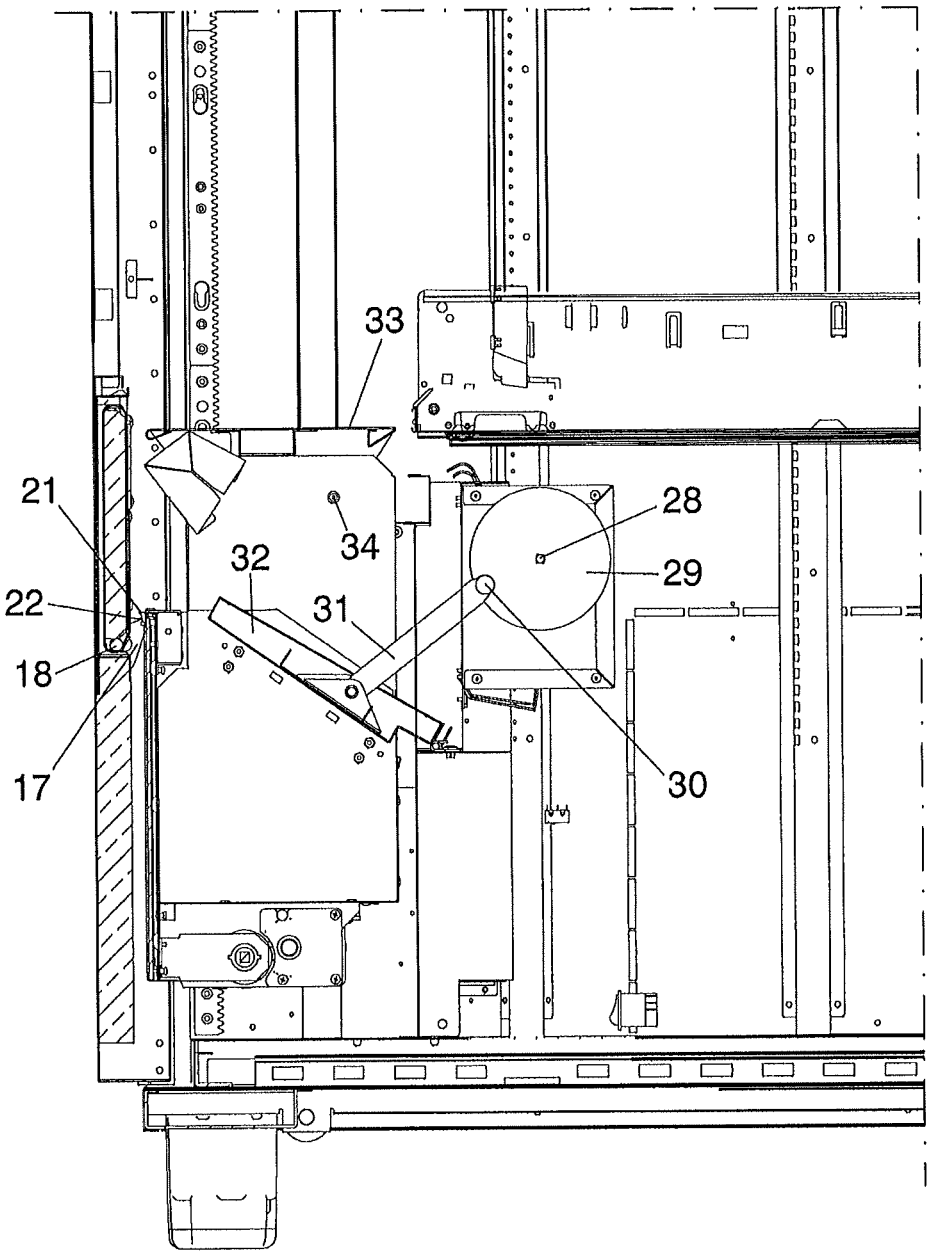
FIG. 5 shows a side sectional view of the dispensing machine of FIG. 1 in the second position, wherein opening of the product collection door is not allowed due to the presence of opening blocking means of said door, in addition to the scanning device that operates in this position.
Figure 6:
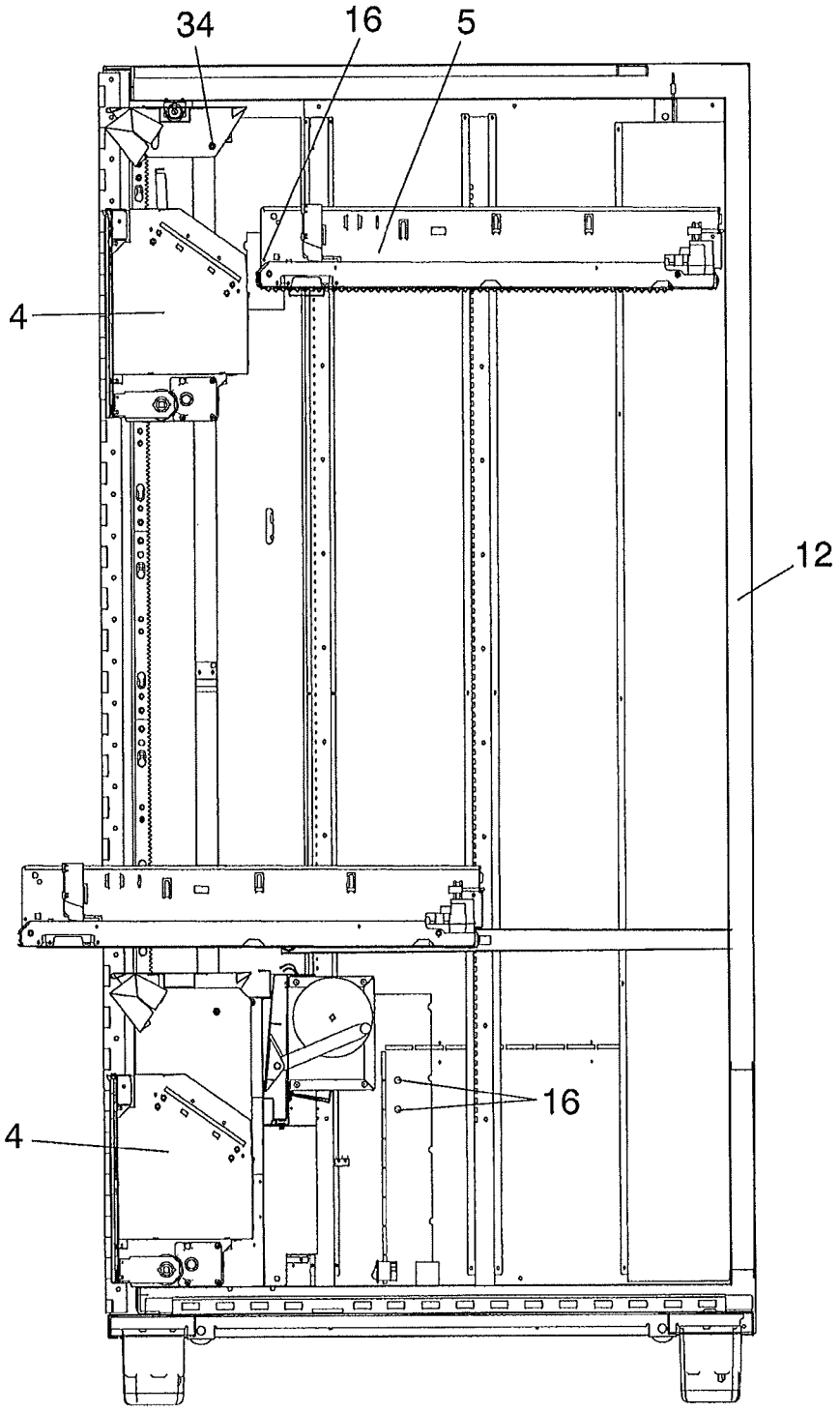
FIG. 6 shows a side sectional view of the dispensing machine of FIG. 1, wherein the elevator has been represented both in the first position and in a product collection position.
Figure 7:
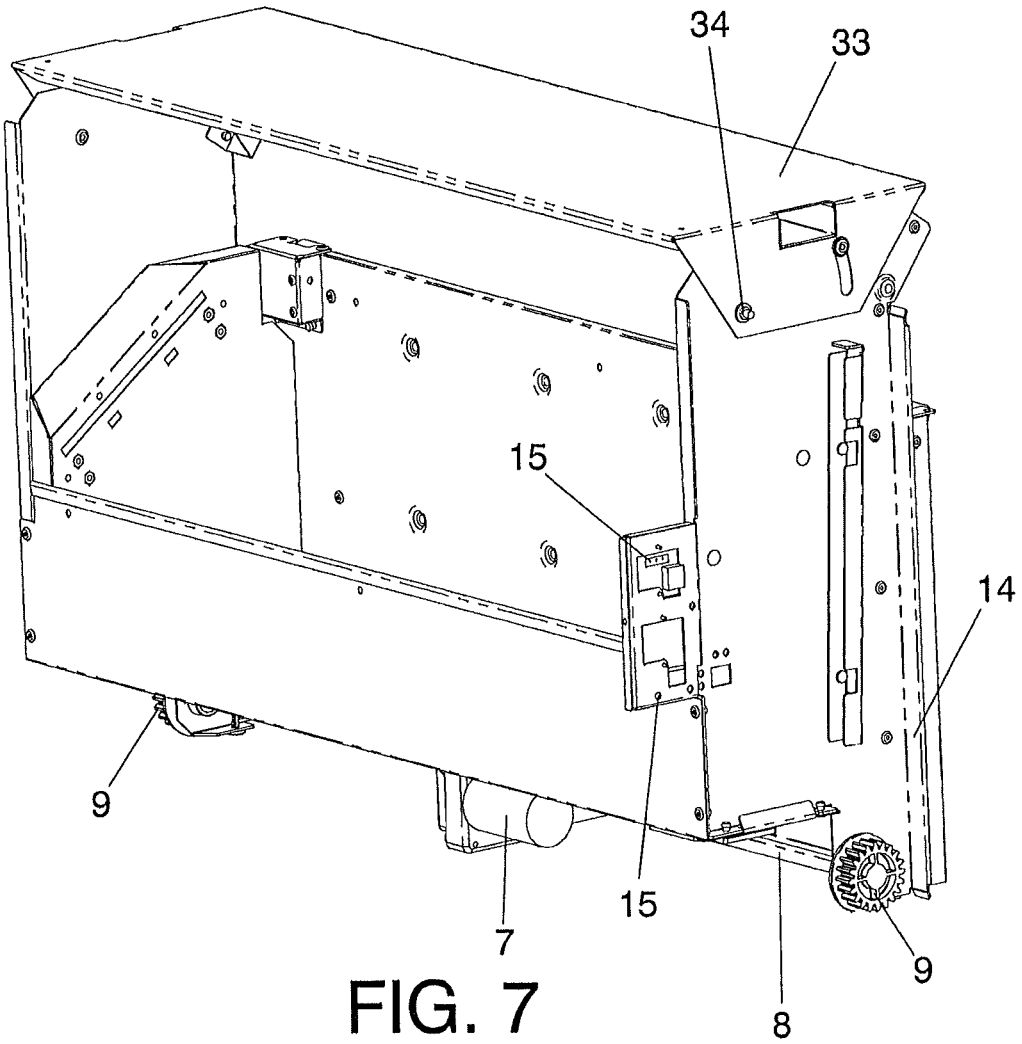
FIG. 7 shows a perspective view of the elevator of the dispensing machine of the present invention.

In a second position wherein the elevator collection box (6) is not disposed opposite to the product (40) collection door (3), opening of the product (40) collection door (3) is not permitted due to opening blocking means of said collection door (3) which are described in detail below. This second position of the elevator (4) with regard to the machine frame (12) is shown in FIG. 5.

The opening blocking means of the collection door (3) comprise latches (17) disposed in the interior of the front part (1) of the machine that retain the collection door (3), specifically stubs (18) that project sideways from the lower part of the collection door (3), by means of an elastic element (19) joined to the latches (17).

The collection door (3) has an upper rotating shaft (20) which allows closing thereof when the elevator (4) is in the first position.

The elevator comprises projections (21) disposed in antagonism to wheels (22) joined to the latches (17), in such a way that when the elevator (4) moves from the second position to the first position, the projections (21) push against the wheels (22) joined to the latches (17) and cause said latches (17) to rotate around their rotating shaft (23), which joins them to the interior of the front part (1) of the machine on overcoming the resistance of an elastic element (19) joined both to the latches (17) and to their rotating shaft (23), releasing the stubs (18) of the collection door (3) and thereby allowing the free movement thereof (3).

When the elevator (4) moves from the first position to the second position, the vertical movement of the elevator projections (21) releases the latches (17) that rotate around their rotating shaft (23) due to the restoring force of the elastic element (19) and are housed inside a cavity (24) in the interior of the front part (1) of the machine, retaining the stubs (18) of the collection door (3) and thereby blocking opening (3) thereof.

The machine has a micro-controller (not shown) disposed between the machine frame (12) and the front part (1) thereof which detects the position of the front part (1) with regard to the frame (12), i.e. it detects whether the front part (1) is closed with regard to the frame (12) or, in other words, if the machine is open or closed.

When the front part (1) is closed with regard to the frame (12), the elevator projections (21) are not in contact with the latches (17) and said latches (17) rotate around their rotating shaft (23) due to the restoring force of the elastic element (19), blocking the opening of the collection door (3).

When the micro-controller informs the machine that the front part (1) is open, the elevator moves from the second position to the first position so that the first tray (5) can be loaded without it (5) being blocked by the elevator (4) itself.

When the micro-controller informs the machine that the front part (1) is closed, the elevator (4) moves from the first position to the second position, where the projections (21) coupled with the elevator (4) come into contact with the latches (17) in the relative position opposite to the position adopted by both elements, latches (17) and projections (21) when the collection door (3) was released during movement from the second position to the first position.

In order to prevent the elevator (4) from becoming blocked by the latches (17), the projections (21) have an elastic element (19) which allows rotation thereof when they encounter an obstacle when moving from the first position to the second position.

The elevator blocking means comprise roller-type stoppers (25) that project from either side of the collection door (3) and rotate coupled with said door (3), in such a way that when the collection door (3) is opened to access the product (40) deposited inside the collection box (6), the rollers (25) are disposed on brackets (26) fixed to the elevator (4) having an upper section (27) that describes the path of travel followed by the rollers (25) during opening of the collection door (3), thereby preventing the elevator (4) from being manipulated from the exterior of the machine through the collection door (3), as the rollers (25) prevent the movement of the elevator and, therefore, passage from the first position to the second position, in order to access the products (40) disposed on the trays (5).

In the second position the machine activates a scanning device that determines the existence of an obstacle which has been introduced from the exterior that prevents normal operation of the elevator (4) before starting its movement towards the product trays (5). This scanning device comprises a motor (not shown) that spins in a first direction and which transmits the movement through a shaft (28) joined to the centre of a circular strip (29), along the periphery of which a pivot (30) is disposed whereto a connecting rod (31) is fixed that transmits the movement to a disk (32) that describes a circle in such a way as to guarantee that there is no obstacle above the detection means, i.e. the photocell bands that determine whether a product has fallen inside the collection box (6).

When the disk (32) is not capable of completing the rotation, it would indicate the existence of an obstacle that interferes therewith (32), moment when the motor rotates in a second direction opposite to the first up to the standby position of the scanning device, said position being defined by a micro-controller with a roller that slides along a circular pinion having a recess where the micro-controller is released (not shown).

At that moment the elevator (4) passes to the first position, informing the machine that the obstacle must be removed.

The elevator (4) also comprises an upper lid (33) preventing to gain access to the tray area from the product collection door (3) in the first or collection position. This upper lid (33) is rotatable, allowing the rotating shaft (20) of the product collection door to be disposed at a greater height than the upper lid (33), which is movable by means of the collection door (3) during movement thereof due to the contact between the collection door (3) and said upper lid (33). Additionally, in this preferred example, the rotating shaft (34) of the upper lid (33) is disposed below said upper lid (33) in the opening position of the collection door (3), reducing the resistance offered by the upper lid (33) to rotation on being operated by the collection door (3).

The invention claimed is:

1. An automatic dispensing machine comprising a front part comprising a rotatable collection door for collecting the products dispensed by the machine, the rotatable collection door comprising a rotational shaft, a frame, and an elevator which carries out both the collection of a certain product disposed on a certain tray of the machine and the movement of the product to a collection box accessible through the rotatable collection door, the collection box being integrated in the elevator and comprising an upper end confronted with a lower end of any of the trays when the elevator collects a product disposed on that tray;

wherein the elevator further comprises a rotatable upper lid with respect to the collection box that allows to dispose the rotatable collection door at least partially above the upper end of the collection box at a first position wherein the collection box is positioned opposite the rotatable collection door and the rotatable collection door can be opened from the exterior of the machine by a user for the collection of the product.

2. The automatic dispensing machine according to claim 1, wherein the upper lid is movable by means of the rotatable collection door during movement thereof, due to the contact between the rotatable collection door and said upper lid.

3. The automatic dispensing machine according to claim 2, wherein the upper lid further comprises a rotational shaft that is disposed below said upper lid in the opening position of the rotatable collection door.

4. The automatic dispensing machine according to claim 1, further comprising opening blocking means of the rotatable collection door to be activated when the elevator collection box is not disposed opposite to the rotatable collection door.

5. The automatic dispensing machine according to claim 4, wherein the opening blocking means of the rotatable collection door comprise latches disposed in the interior of the front part of the machine that retain stubs projecting laterally from the lower part of the rotatable collection door due to the action of an elastic element joined to the latches.

6. The automatic dispensing machine according to claim 5, wherein the elevator comprises antagonistically disposed projections that push wheels joined to the latches and cause said latches to rotate around their rotating shaft, which joins the latches to the interior of the front part of the machine, the antagonistically disposed projection configured to overcome the resistance of the elastic element when the elevator collection box moves from a non-opposed position to an opposed position with regard to the rotatable collection door, releasing the stubs of the rotatable collection door and thereby allowing the free movement thereof.

7. The automatic dispensing machine according to claim 6, wherein the projections comprise an elastic element allowing rotation thereof when they encounter an obstacle in their movement from an opposed position to a non-opposed position of the elevator collection box with regard to the rotatable collection door in order to prevent the latches from blocking the elevator.

8. The automatic dispensing machine according to claim 1, further comprising elevator blocking means which become activated when the elevator collection box is disposed opposite to the rotatable collection door, said blocking means allowing opening of the rotatable collection door from the exterior of the machine by a user but preventing the elevator from moving through the rotatable collection door to access the products disposed in the trays.

9. The automatic dispensing machine according to claim 8, wherein the elevator blocking means comprise roller-type stoppers projecting from either side of the rotatable collection door in such a way that, when the rotatable collection door opens to access the product deposited in the collection box, the rollers are disposed on brackets fixed to the elevator, thereby preventing the elevator from being manipulated from the exterior of the machine through the rotatable collection door, as the rollers prevent the elevator from moving.

10. The automatic dispensing machine according to claim 1, further comprising detection means that determine whether a product has fallen inside the collection box or not.

11. The automatic dispensing machine according to claim 1, further comprising a scanning device that determines the existence of an external obstacle introduced from the exterior that prevents normal operation of the elevator before starting its movement towards the product trays.

12. The automatic dispensing machine according to claim 10, further comprising a scanning device that determines the existence of an external obstacle introduced from the exterior that prevents normal operation of the elevator before starting its movement towards the product trays.

13. The automatic dispensing machine according to claim 12, wherein the scanning device comprises a motor rotatable in a first direction to transmit the movement through a shaft joined to the centre of a circular strip, having a pivot disposed on the periphery thereof whereto a connection rod is fixed which transmits the movement to a disk which describes a circle that guarantees the absence of obstacles above the detection means.

14. The automatic dispensing machine according to claim 13, wherein the scanning device comprises a micro-controller having a roller that slides along a circular pinion having a recess, said micro-controller being released when said scanning device is on standby.

15. The automatic dispensing machine according to claim 14, wherein the motor is rotatable in a second direction opposite to the first up to the standby position of the scanning device when the disk is unable to complete the circle due to the existence of an obstacle that interferes with said disk.

16. The automatic dispensing machine according to claim 1, further comprising one or several extractors disposed between the trays and the elevator to drag the product from a channel of a certain product from among those disposed in each tray to the elevator, which is positioned in front of the tray that includes the row wherefrom the product will be extracted.

17. The automatic dispensing machine according to claim 1, further comprising a first device for positioning the elevator with regard to the machine frame in order to determine the position of the elevator with regard to the frame, and a second device for positioning the elevator with regard to the trays, in order to determine the relative position between the elevator and the trays.

18. The automatic dispensing machine according to claim 1, wherein the rotatable upper lid is entirely disposed on top of the collection box in a non-opposed position of the elevator collection box with regard to the rotatable collection door.

19. An automatic dispensing machine comprising a front part comprising a rotatable collection door for collecting the products dispensed by the machine, the rotatable collection door comprising a rotational shaft, a frame, and an elevator which carries out both the collection of a certain product disposed on a certain tray of the machine and the movement of the product to a collection box accessible through the rotatable collection door, the collection box being integrated in the elevator;

wherein the elevator further comprises a rotatable upper lid that allows to dispose the rotatable collection door at least partially above an upper end of the collection box at a first position wherein the collection box is positioned opposite the rotatable collection door and the rotatable collection door can be opened from the exterior of the machine by a user for the collection of the product;

further comprising elevator blocking means which become activated when the elevator collection box is disposed opposite to the rotatable collection door, said blocking means allowing opening of the rotatable collection door from the exterior of the machine by a user but preventing the elevator from moving through the rotatable collection door to access the products disposed in the trays;

wherein the elevator blocking means comprise roller-type stoppers projecting from either side of the rotatable collection door in such a way that, when the rotatable collection door opens to access the product deposited in the collection box, the rollers are disposed on brackets fixed to the elevator, thereby preventing the elevator from being manipulated from the exterior of the machine through the rotatable collection door, as the rollers prevent the elevator from moving.

20. An automatic dispensing machine comprising a front part comprising a rotatable collection door for collecting the products dispensed by the machine, the rotatable collection door comprising a rotational shaft, a frame, and an elevator which carries out both the collection of a certain product disposed on a certain tray of the machine and the movement of the product to a collection box accessible through the rotatable collection door, the collection box being integrated in the elevator;

wherein the elevator further comprises a rotatable upper lid that allows to dispose the rotatable collection door at least partially above an upper end of the collection box at a first position wherein the collection box is positioned opposite the rotatable collection door and the rotatable collection door can be opened from the exterior of the machine by a user for the collection of the product;

further comprising detection means that determine whether a product has fallen inside the collection box or not; and further comprising a scanning device that determines the existence of an external obstacle introduced from the exterior that prevents normal operation of the elevator before starting its movement towards the product trays;

wherein the scanning device comprises a motor, rotatable in a first direction to transmit the movement through a shaft joined to the centre of a circular strip, having a pivot disposed on the periphery thereof, whereto a connection rod is fixed which transmits the movement to a disk which describes a circle that guarantees the absence of obstacles above the detection means.

* * * * *